US010608373B1

(12) United States Patent
Nogues et al.

(10) Patent No.: US 10,608,373 B1
(45) Date of Patent: Mar. 31, 2020

(54) ELECTRICAL CONNECTOR ASSEMBLY

(71) Applicants: TI Automotive Technology Center GmbH, Restatt (DE); SPI Automotive N.A. Inc., Rochester Hills, MI (US)

(72) Inventors: Aritz Nogues, Warren, MI (US); M.Salman Khan, Rastatt (DE); Romana Vonkova, Ludwigshafen am Rhein (DE)

(73) Assignees: TI Automotive Technology Center GmbH, Restatt (DE); SPI Automotive N.A. Inc., Rochester Hills, MI (US)

( * ) Notice: Subject to any disclaimer, the term of this patent is extended or adjusted under 35 U.S.C. 154(b) by 0 days.

(21) Appl. No.: 16/139,809

(22) Filed: Sep. 24, 2018

(51) Int. Cl.

| | |
|---|---|
| ***H01R 13/533*** | (2006.01) |
| ***H01R 13/405*** | (2006.01) |
| ***H01R 13/502*** | (2006.01) |
| ***H01R 13/52*** | (2006.01) |
| ***H01R 13/436*** | (2006.01) |

(52) U.S. Cl.
CPC ..... *H01R 13/533* (2013.01); *H01R 13/405* (2013.01); *H01R 13/436* (2013.01); *H01R 13/502* (2013.01); *H01R 13/52* (2013.01); *H01R 2201/26* (2013.01)

(58) Field of Classification Search
CPC .. H01R 13/523; H01R 13/533; H01R 13/405; H01R 13/436; H01R 13/502; H01R 13/52; H01R 2201/26; H01R 24/00; H01R 24/60; H01R 13/64; H01R 33/965
USPC ..... 439/345, 190, 283, 660, 677, 680
See application file for complete search history.

(56) References Cited

U.S. PATENT DOCUMENTS

| | | | | |
|---|---|---|---|---|
| 4,455,056 | A * | 6/1984 | Herrmann, Jr. | H01R 13/53 439/284 |
| 6,364,718 | B1 * | 4/2002 | Polgar | H01R 13/64 439/488 |
| 6,758,700 | B2 * | 7/2004 | Konno | H01R 13/631 439/595 |
| 7,597,580 | B1 * | 10/2009 | Advey | H01R 13/502 439/272 |
| 8,297,260 | B2 | 10/2012 | Masuda et al. | |
| 8,348,703 | B2 * | 1/2013 | De Blieck | H01R 43/16 439/378 |
| 8,951,058 | B2 | 2/2015 | Favero et al. | |
| 9,673,564 | B2 * | 6/2017 | Feldner | H01R 13/502 |

FOREIGN PATENT DOCUMENTS

EP 2593993 B1 5/2015

* cited by examiner

*Primary Examiner* — Travis S Chambers
(74) *Attorney, Agent, or Firm* — Dickinson Wright PLLC

(57) ABSTRACT

An electrical connector assembly having a female member and a male member is provided. The female member includes: a peripheral wall formed in an annular shape to define a first interior space; a plurality of exterior walls each formed in a semi-annular shape to define a plurality of second interior spaces located outwardly of the first interior space. In particular, the peripheral wall includes a plurality of slots corresponding to the plurality of exterior walls, and the plurality of slots communicates the first interior space with the plurality of second interior spaces. The male member includes a plurality of partition walls sized to be received by corresponding second interior spaces and slots whereby the partition walls separate the first interior space into corresponding chambers for each electrical prong of the male member.

10 Claims, 9 Drawing Sheets

ELECTRICAL CONNECTOR ASSEMBLY

FIELD

The present disclosure relates to an electrical connector assembly for a vehicle and the electrical assembly may include a male connector and female connector.

BACKGROUND

The statements in this section merely provide background information related to the present disclosure and may not constitute prior art.

In order to operate and control a vehicle, the vehicle is equipped with various electric and mechanical devices such as an engine, a transmission, a fuel tank, wheels etc., and electrical cables and connectors are used to transfer electric power or signals between those devices. Depending on locations of those devices and electric components (connectors, cables), those are exposed to different environments and thus are specifically designed to be suitable for the use in specific locations and conditions.

For example, a fuel tank to store fuel for a vehicle includes a fuel pump to discharge the fuel from the fuel tank to an engine of the vehicle through a fuel line, and the delivered fuel is injected into cylinders of the engine to be burned to generate power to run the engine. The fuel pump operates with electric power transferred from a battery or a generator via electric power cables, and the power cables are connected to the fuel pump and other sensors like a fuel level sensor that gages the level of fuel inside the fuel tank. As the fuel tank is filled with fuel, those electric cables and connectors disposed inside of the fuel tank are in direct contact with the fuel.

Since the electric cables are electrically connected to the fuel pump and sensors via electric connectors, the connections between the electric cables, the connectors, and electrical terminals for the fuel pump and sensors need a certain type of sealing that inhibits or prevents the entry of fuel into the connectors for the electric terminals and cables of the pump and sensors.

Permeation of fuel into the connectors causes the electrical terminals of the pump or the sensors to contact with the fuel and results in chemical and/or electrolytic corrosion of the electric terminals of the pump and sensors. In particular, highly conductive fuel such as alcohol-mixed fuel or ethanol-fixed fuel dramatically increases conductivity than ordinary gasoline, and thus the electrolytic corrosion of the electric terminals becomes much more problematic.

In general, electrolytic corrosion occurs when two terminals with opposite polarities are exposed to fuel in the same space. For example, if a positive terminal and a negative terminal coexist in the same space (e.g., a chamber) of an electric connector, a current path is formed via the fuel when it has entered into the chamber. As a result, electrochemical corrosion (electrolytic corrosion) is caused in both the terminals and eventually breaks in electric continuity between the terminals housed in the electrical connector. The alcohol blended fuel or the ethanol type fuel escalates electrolytic corrosion. We have discovered that such electrolytic corrosion is more easily produced if a distance between both the terminals (i.e., positive and negative terminals) which coexist in the same chamber of the electric connector is shorter and thus separation of the terminals and longer distance between the terminals are desired.

SUMMARY

The present disclosure provides a compact connector assembly with individual chamber for each terminal to improve sealing effect and reduce the risk of electrolytic corrosion so that the durability and lifetime of electric connectors is improved.

In one form, the present disclosure provides an electrical female connector having an upper open end for an electrical male connector formed with a plurality of partition walls. The electric female connector includes: a lower plate; a peripheral outer wall extended from the lower plate in a first direction (Z-direction) transversely and configured to delimit an inner cavity of the electric female connector with the lower plate, wherein the peripheral wall has a plurality of slots that is formed along the first direction and configured to divide the peripheral outer wall into a plurality of wall sections; and a plurality of protruding side walls each protruding from the peripheral outer wall outwardly and respectively configured to continuously connect at least two divided wall sections of the plurality of wall sections to each other such that the peripheral outer wall and the plurality of protruding side walls form a continuous exterior wall of the electrical female connector.

In particular, each of the plurality of protruding side walls forms a chamber to receive a corresponding portion of partition walls of the electrical male connector, and the respective slot and the respective chamber form a cross sectional profile compatible with a cross sectional profile of the corresponding portion of the partition wall of the electrical male connector. With this arrangement, when the partition walls of the electrical male connector are respectively inserted into the corresponding chambers of the electrical female connector along the respective slot, the inner cavity of the electrical female connector is divided into a plurality of insulated chambers for each electrical post.

In another form, the chambers are open to the inner cavity through the corresponding slot, and the respective slot and the respective chamber form together a cross sectional profile compatible with a cross sectional profile of the corresponding partition wall of the electrical male connector.

The electrical female connector may further include a plurality of inward protrusions that each protrudes inwardly from the corresponding protruding side walls and respectively divides the corresponding slot of the plurality of slots into a first sub-slot and a second sub-slot. And, at least two inward protrusions of the electrical female connector face to each other and form a gap "G" to receive a corresponding portion of the partition walls of the electrical male connector. In one form, a length of inward protrusion of the facing partition walls is set to be different from each other.

In another aspect of the present disclosure, the plurality of protruding side walls and the first and second sub-slots are formed in pairs, and each pair has the inward protrusion and first and second sub-slots facing the other inward protrusion and first and second sub-slots of the pair, whereby each pair forms an opening profile compatible with a H-shaped cross section of the corresponding partition wall of the electrical male connector so as to form the plurality of insulated chambers.

In other form of the present disclosure, an electrical connector assembly is provided, and the connector assembly includes a female member coupled with a male member. The female member may include: a peripheral wall formed in an annular shape to define a first interior space; a plurality of exterior walls located on an exterior of the peripheral wall, and the plurality of exterior walls are each formed in a semi-annular shape to define a plurality of second interior spaces located outwardly of the first interior space. In particular, the peripheral wall may include a plurality of slots corresponding to the plurality of exterior walls, and the plurality of slots communicates the first interior space with the plurality of second interior spaces.

The male member may include a plurality of partition walls sized to be received by corresponding second interior spaces and slots, whereby the partition walls separate the first interior space into corresponding chambers for each electrical prong of the male member.

In still other form, a plurality of electrical posts may be arranged on a lower plate of the female member, and each of the electrical post is housed in the corresponding chamber and configured to couple with the corresponding electrical prong of the male member.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
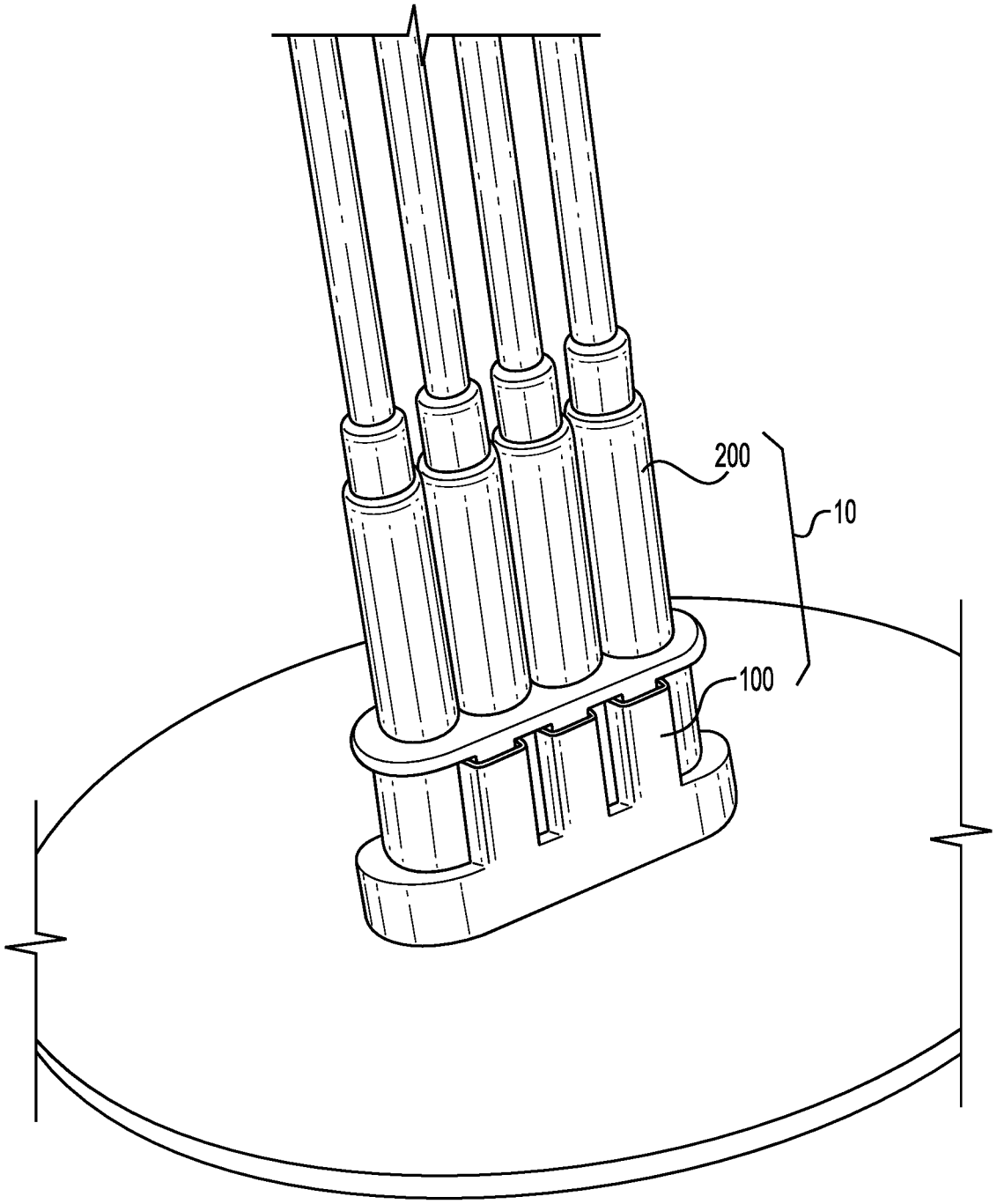
FIG. 1 is a perspective view of an electrical connector assembly.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows an electrical connector assembly 10 as one form of the present disclosure. The electrical connector assembly 10 includes an electrical female connector 100 and an electrical male connector 200. The electrical male connector 200 is fitted into the electrical female connector 100 in a water tight manner to inhibit intrusion of liquid such as fuel into the inside of the electrical connector assembly so as to reduce risk of electrolytic corrosion between electrical terminals housed inside of the electrical connector assembly. In one form, the electrical connector assembly 10 is disposed inside of a fuel tank of a vehicle and thus exposed to fuel stored in the fuel tank.

Figure 2:
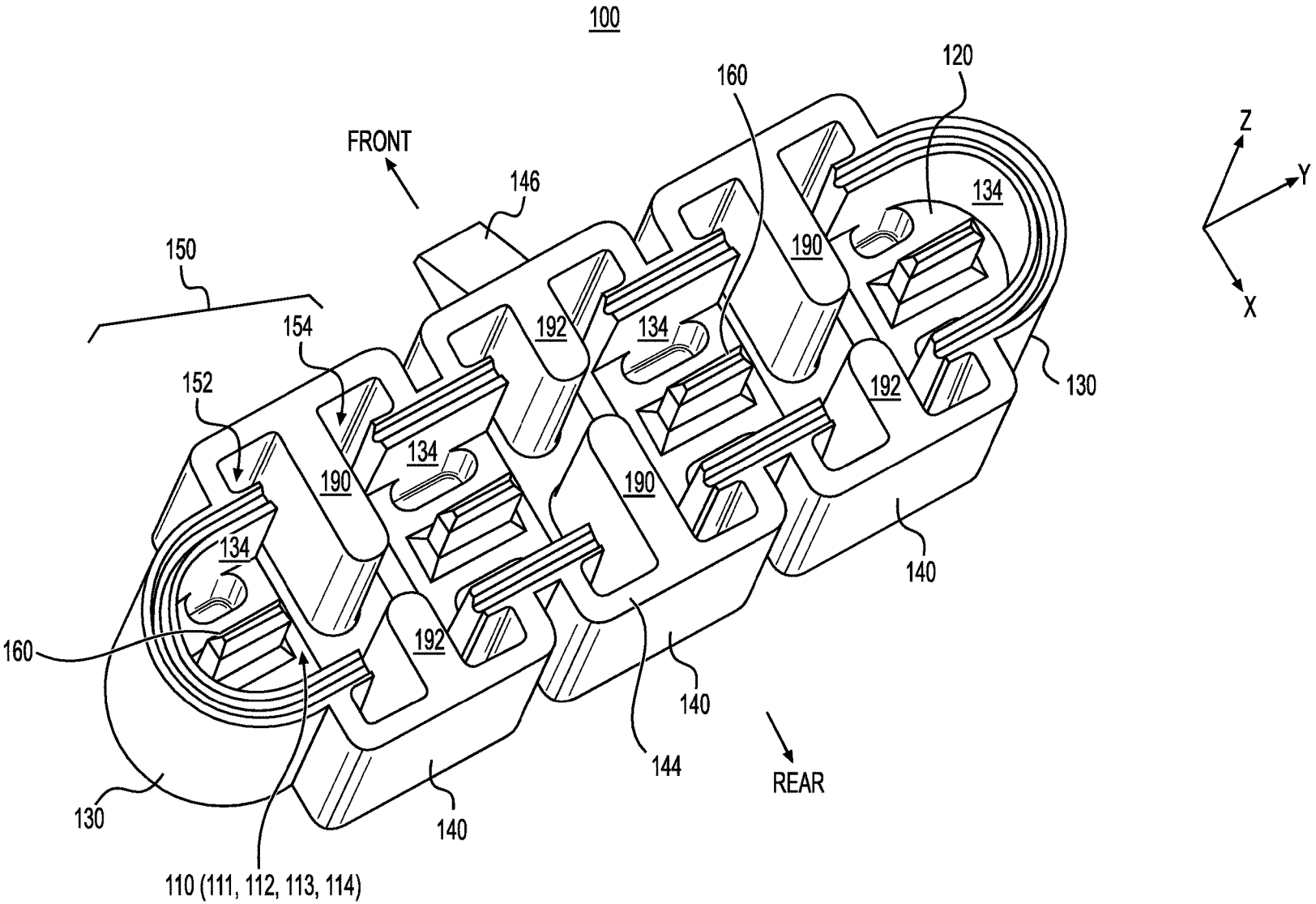
FIG. 2 is a perspective view of an electrical female connector.
Figure 3A:
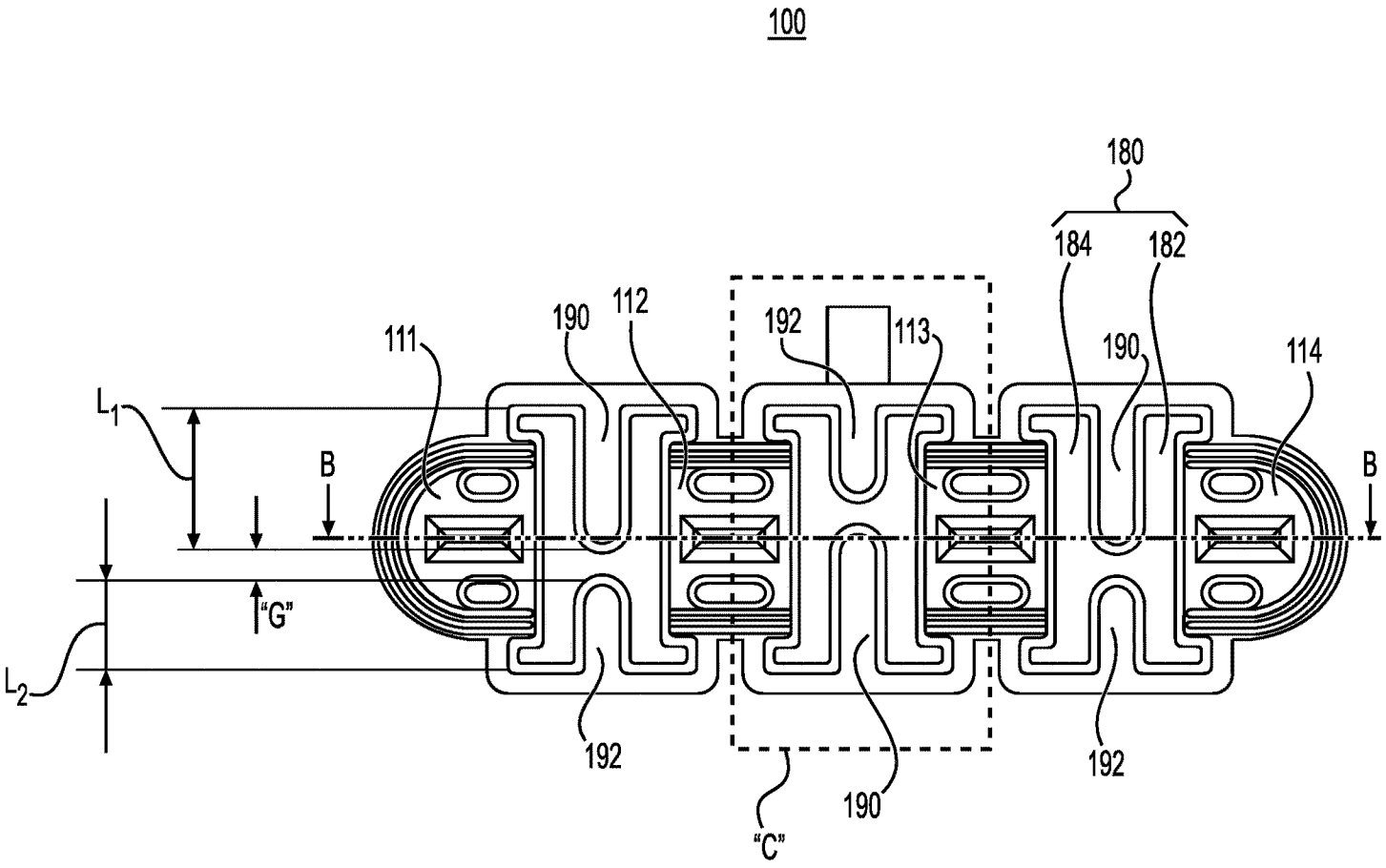
FIG. 3A is a top view of the electrical female connector.
Figure 3C:
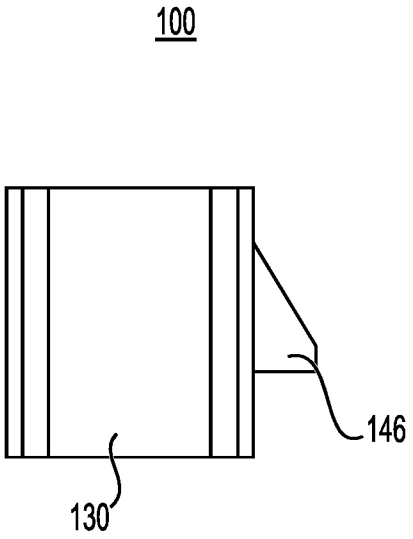
FIG. 3C is a side view of the electrical female connector.
Figure 3B:
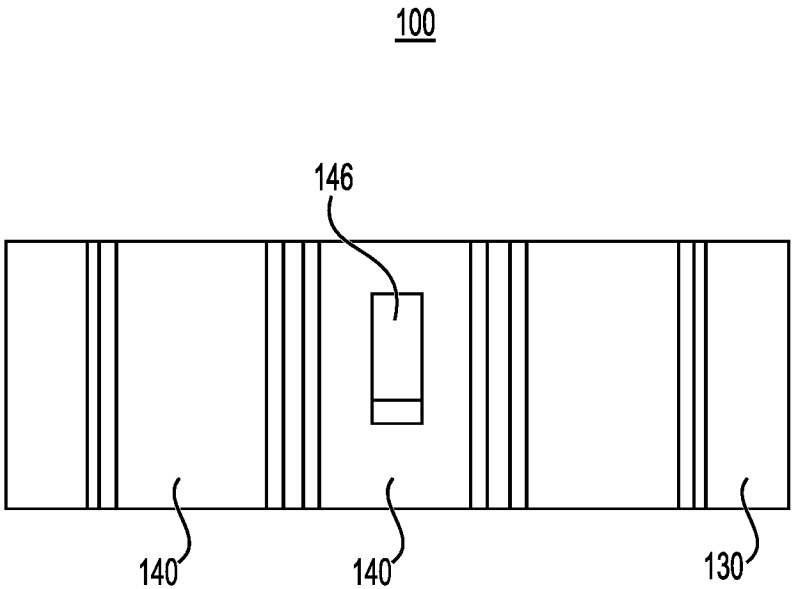
FIG. 3B is a front view of the electrical female connector.
Figure 3D:
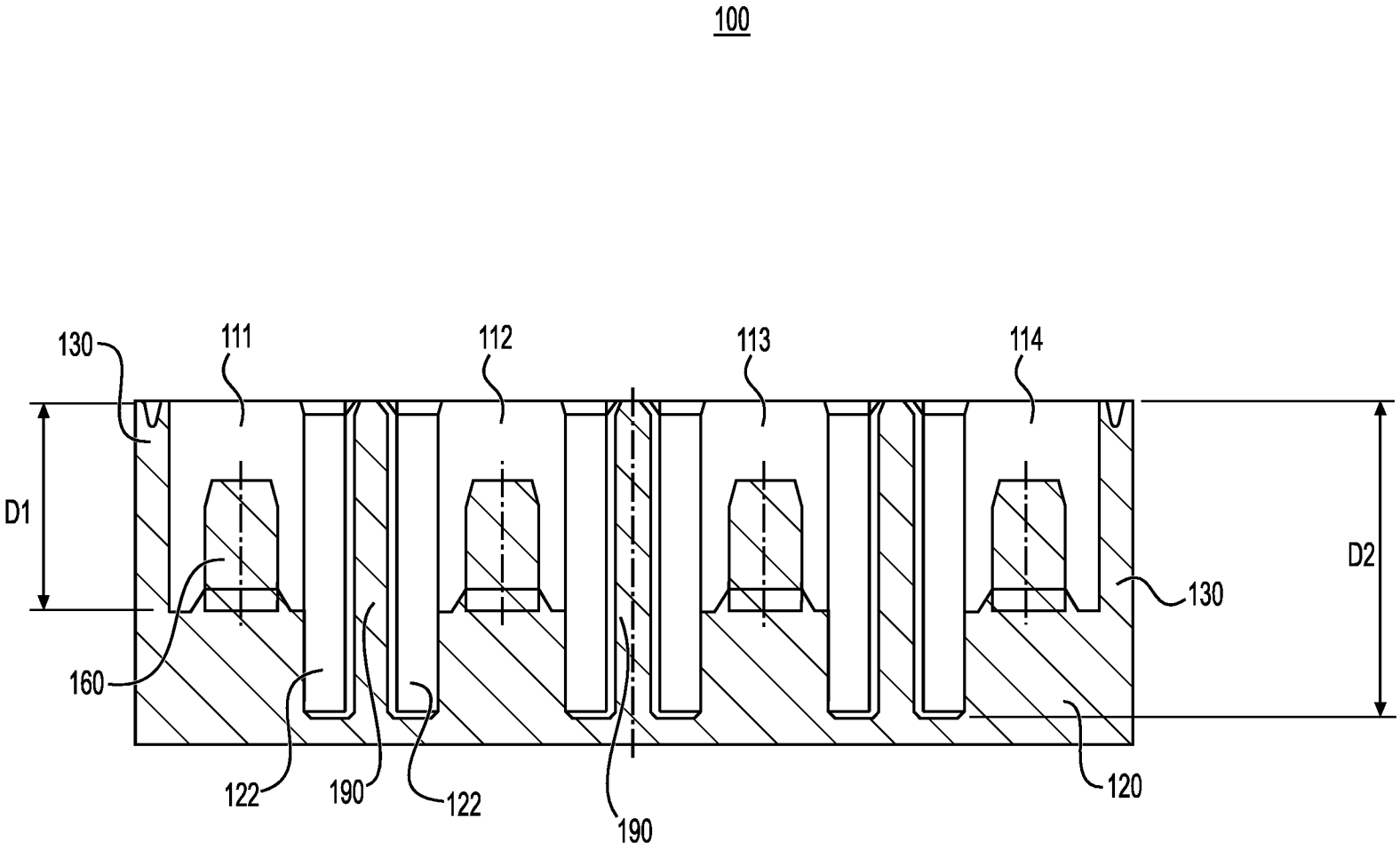
FIG. 3D is a cross-sectional view of the electrical female connector along B-B line in FIG. 3A.

The structure of the electrical female connector 100 and male connector 200 in one form of the present disclosure will be described in detail with FIGS. 2-5. FIG. 2 is a perspective view of the electrical female connector 100, and FIG. 3A is a top view of the electrical female connector 100. FIG. 3B is a front view of the electrical female connector 100, FIG. 3C is a side view of the electrical female connector 100, and FIG. 3D is a cross-sectional view of the electrical female connector along B-B line in FIG. 3A in one form of the present disclosure.

Referring to FIGS. 2 and 3A-3D, the electrical female connector 100 has an upper open end into which the electrical male connector 200 is inserted, and the electric female connector 100 further includes: a lower plate 120; a peripheral outer wall 130 that is extended from the lower plate in a first direction (Z-direction) transversely and delimits an inner cavity 110 of the electric female connector with the lower plate. In particular, the peripheral wall 130 has a plurality of slots 180 (182, 184) that is formed along the first direction and divides the peripheral outer wall 130 into a plurality of wall sections 134. The divided wall sections 134 are continuously connected to each other by protruding side walls 140. Each of the protruding side walls 140 protrudes from the peripheral outer wall 130 outwardly and continuously connects at least two divided wall sections 134 to each other such that the peripheral outer wall 130 and the plurality of protruding side walls 140 form a continuous exterior wall of the electrical female connector 100. As shown in FIGS. 2 and 3A, a far-left wall section and a far-right wall section 134 have a different shape compared to the other wall section that are arranged between the far-right and far-left wall sections. In one form, the far-left wall section and the far-right wall section 134 are in a semi-annular shape, and the other middle positioned wall sections are a flat shape.

Figure 4A:
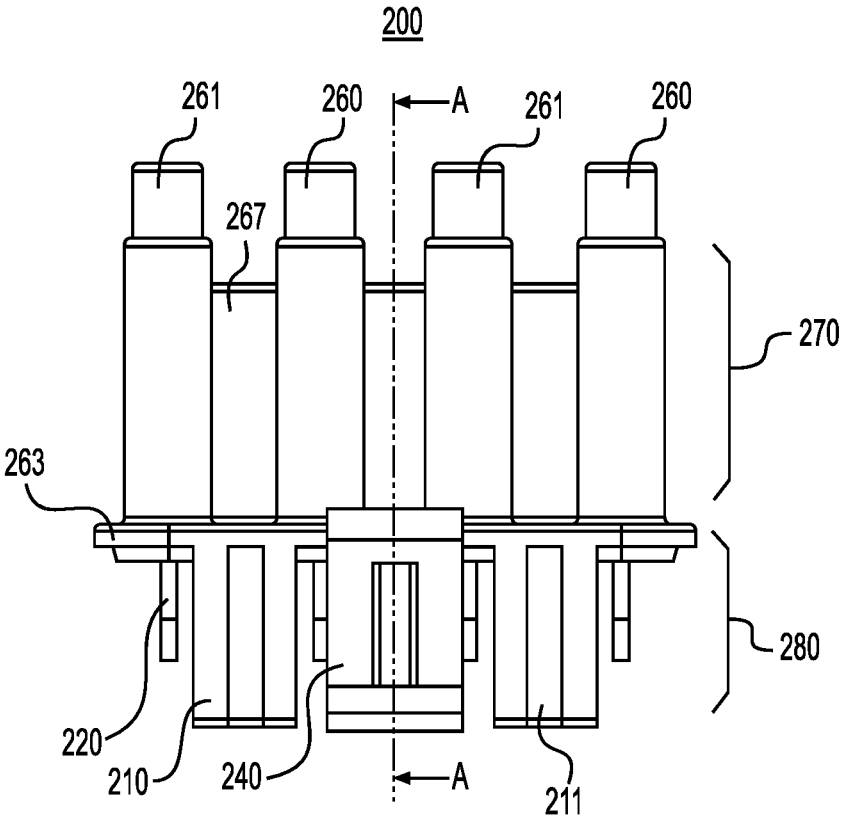
FIG. 4A is a front view of an electrical male connector.
Figure 4B:
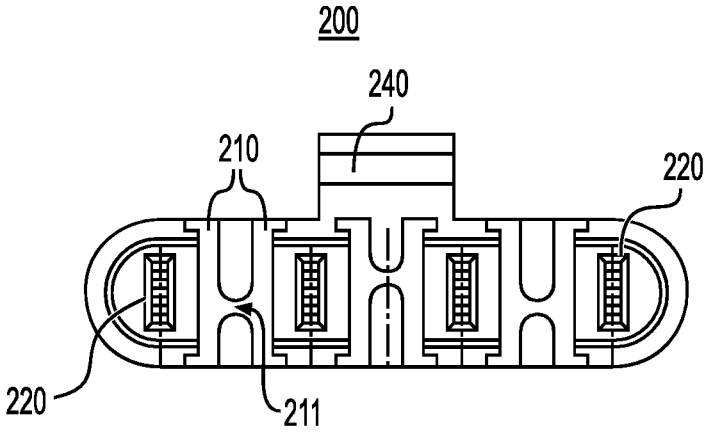
FIG. 4B is a bottom view of the electrical male connector.
Figure 4C:
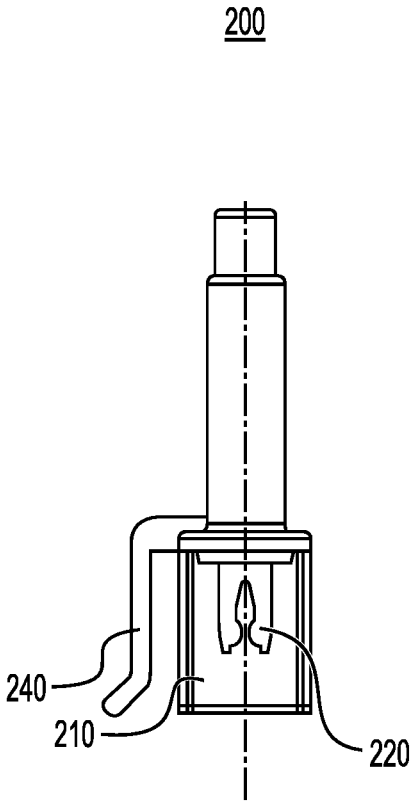
FIG. 4C is a side view of the electrical male connector.
Figure 4D:
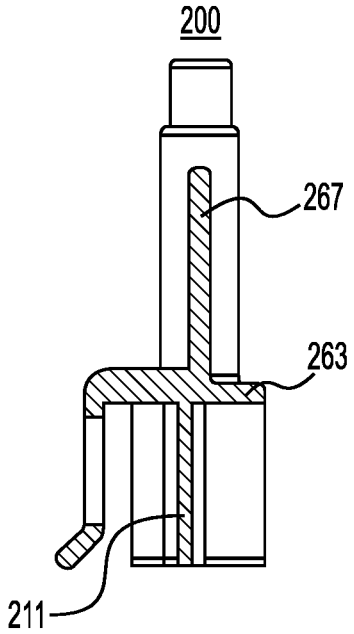
FIG. 4D is a cross-sectional view of the electrical male connector along A-A line in FIG. 4A.
Figure 5:
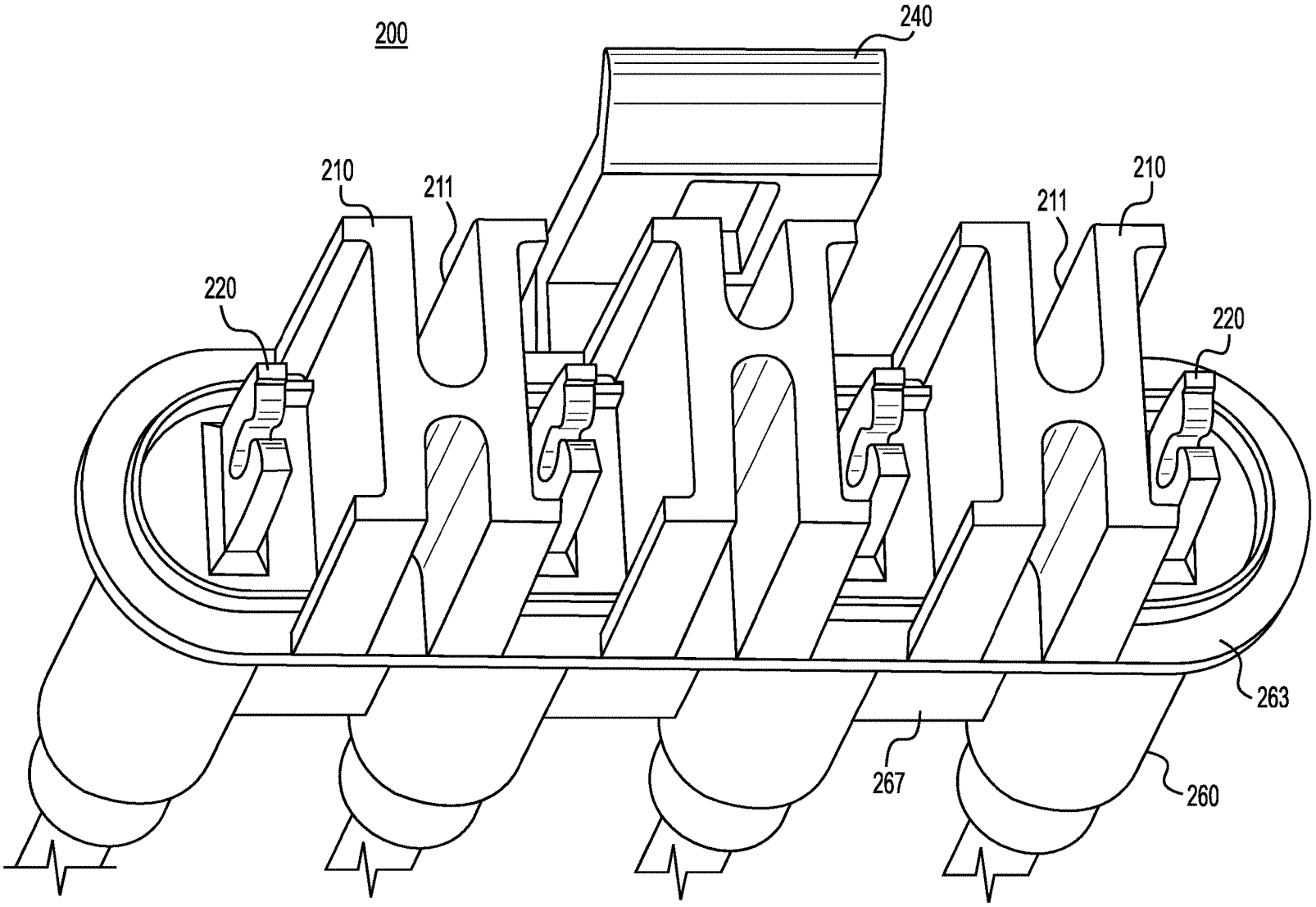
FIG. 5 is a perspective view of an electrical male connector.

FIGS. 4A-4D and FIG. 5 illustrate the detailed structure of the electrical male connector 200. FIG. 4A is a front view of the electrical male connector 200 in one form of the present disclosure, FIG. 4B is a bottom view of the electrical male connector, FIG. 4C is a side view of the electrical male connector, and FIG. 4D is a cross-sectional view of the electrical male connector along A-A line in FIG. 4A. FIG. 5 is a perspective view of the electrical male connector in one form of the present disclosure.

Referring to FIGS. 2, 3A and 4A-4C, each of the plurality of protruding side walls forms a chamber 150 (152, 154) to receive a corresponding portion of partition walls 210 of the electrical male connector 200, and the respective slot 180 and the respective chamber 150 of the electrical female connector 100 form a cross sectional profile compatible with a cross sectional profile of the corresponding portion of the partition wall 210 of the electrical male connector 200. With this configuration, when the partition walls 210 of the electrical male connector are respectively inserted into the corresponding chambers of the electrical female connector along the respective slot, the inner cavity 110 of the electrical female connector is divided into a plurality of insulated chambers 111, 112, 113, 114 for each electrical post 160 and a corresponding electrical prong 220 of the electrical male connector that is coupled with the electrical post in one of the insulated chambers.

As illustrated in FIGS. 2 and 3D, a plurality of electrical posts 160 are arranged on the lower plate 120 of the female connector 100, and each of the electrical posts 160 is housed in the corresponding chamber 111, 112, 113, 114 and coupled with the corresponding electrical prong 220 of the electrical male connector 200.

In one form, the chambers 150 (152, 154) of the electrical female connector 100 are open to the inner cavity 110 through the corresponding slot 180 (182, 184), and a downward end portion of the partition walls 210 of the electrical male connector 200 is respectively fitted into grooves 122 formed in the upper surface of the lower plate 120 when the partition walls 210 of the electrical male connector are inserted into the chambers 150 (152, 154) and the slots 180 (182, 184) of the electrical female connector such that the inner cavity 110 of the electrical female connector 100 is divided into a plurality of insulated chambers 111, 112, 113, 114 in which respective electrical post 160 and electrical prong 220 are mechanically and electrically connected to each other.

For example, a negative electrical post 160 is coupled to a negative electrical prong 220 in the insulated chamber 111 whereas a positive electrical post 160 is coupled to a positive electrical prong in another insulated chamber 112. The insulated chambers 111 and 112 are separated by the inserted partition wall 210 of the electrical male connector 200 and also by partition walls (i.e., inward protrusions) 190, 192 of the electrical female connector 100 which will be described in detail below.

In one form, the electrical female connector 100 includes a plurality of inward protrusions 190, 192 that each protrudes inwardly from the respective protruding side walls 140 and respectively divides the corresponding slot 180 of the plurality of slots into a first sub-slot 182 and a second sub-slot 184 as shown in FIGS. 2 and 3A. In another form, at least two inward protrusions 190, 192 of the electrical female connector 100 face to each other and form a gap "G" to receive a corresponding portion 211 of the partition walls 210 of the electrical male connector 200. In another form, the two facing inward protrusions 190, 192 of the electrical female connector 100 are integrated in one wall without any gap, forming a single partition wall if desired.

In another form, a length of the inward protrusions 190, 192 is set to be different from each other. For example, as shown in FIGS. 2 and 3A, the length "L1" of the inward protrusion 190 in a X direction is longer than the length "L2" of the other inward protrusion 192, forming the gap "G". The long and short inward protrusions 190, 192 may be alternatively arranged along the exterior wall of the electrical female connector 100 in a Y direction. This arrangement provides additional barrier to interrupt circulation of fuel inside of the electrical connector assembly or female connector when the fuel enters inside of the electrical female connector.

FIG. 3D is a cross-sectional view of the electrical female connector along B-B line in FIG. 3A and illustrates different depths to receive electrical prongs 220 and the partition walls 210 of the electrical male connector 200. In detail, the depth "D1" of the insulated chambers 111, 112, 113, 114 of the female connector 100 to receive the electrical prongs 220 is less that the depth of portions of the female connector 100 to receive the partition walls 210 of the male connector 200 such that the partition walls 210 of the male connector are more tightly and securely fitted into the lower plate 120. In addition, the difference in the depths creates another barrier to block the flow of fuel that enters into the female connector between the insulated chambers 111, 112, 113, 114 so that the risk of electrolytic corrosion that occurs when opposite polarities are exposed to the same fuel in same space is significantly reduced.

Referring to FIGS. 4A-4D and FIG. 5, the portion 211 of the partition walls 210 of the electrical male connector 200 is in a form of a web connecting two neighboring partition walls 210, which are parallel to each other, and forms together a "H" shape cross-section. Thus, the electrical female connector 100 provides an opening profile compatible with the H-shaped cross section of the partition wall 210 of the electrical male connector 200 so as to tightly engage with each other.

As described above, since the long and short inward protrusions 190, 192 may be alternatively arranged along the exterior wall of the electrical female connector 100, the position of the gap "G" formed between the two inward protrusions 190, 192 of the electrical female connector 100 varies accordingly and thus the position of the portion 211 of the partition walls 210 is respectively arranged according to the position of corresponding gap "G" of the female connector to be properly engaged.

Referring to FIGS. 2 and 3A, the plurality of protruding side walls 140 and the first and second sub-slots 182, 184 are formed in pairs. For example, a first pair has the inward protrusion 190 and first and second sub-slots 182, 184, and a second pair that faces the first pair has other inward protrusion 192 and first and second sub-slots 182, 184 such that the first and second pairs that face to each other form an opening profile compatible with a H-shaped cross section of the corresponding partition wall 210 of the electrical male connector 200 such that the plurality of insulated chambers 111, 112, 113, 114 are formed. The multiple partition walls 210 of the electrical male connector 200 arranged along the Y direction are set to be identical to the number of the chambers 150 (152, 154) so as to divide the inner cavity 110 of the electrical female connector into the desired independent/insulated chambers 111, 112, 113, 114.

As shown in FIGS. 4A-4D and FIG. 5, the electrical male connector 200 includes a terminal part 280 that is encased into the electrical female connector 100, and a body part 270 embedded with electric cables 260, 261. The body part 270 and the electric cables 260, 261 may be formed in one body by molding, and each cables 260, 261 may be tied together by an intermediate flange 267 made of polyoxymethylene (POM) or the like. An upper plate 263 is disposed between the body part 270 and the terminal part 280, and has a shape compatible with the upper opening of the electrical female connector 100 so as to fully cover the upper opening when the terminal part 280 of the electrical male connector 200 is encased into the female connector. The partition walls 210 and electrical prongs 220 of the male connector 200 are projected from the upper plate in opposite direction to the electric cables 260, 261 (namely, in a downward direction toward the female connector), and fitted into the corresponding slots and electrical posts 160 of the female connector 100. When the terminal part 280 of the electrical male connector 200 is inserted into the female connector 100, the upper surface 144 of the exterior wall of the female connector abuts against the lower surface of the upper plate 263 and is sealed together.

The electrical male connector 200 also has an outer locking means 240 to enable to lock to a projection 146 of the electrical female connector 100 to provide better fastening between the electrical male and female connectors. As illustrated in FIGS. 4A, 4C-4D, the outer locking means of the electrical male connector is a clamp 240 which extends from one of the side peripheral edges of the upper plate 263, extending downward, in parallel to the exterior wall of the protruding side wall 140. This clamp has a cut out in its central part to assist in fastening and enable the coupling between the female and male connectors. In contrast, the projection 146 of the electrical female connector is in a form of a projection molded on the outer face of the protruding side wall 140, and has a shape and sized to be compatible with the cut out of the clamp 240 to be fixedly engaged together.

As described above in connection with FIGS. 3A and 4A-4B, the electrical female connector 100 provides an opening profile compatible with the H-shaped cross section of the partition wall 210 of the electrical male connector 200. With this structure, a negative electrical post 160 may be coupled to a negative electrical prong 220 in the insulated chamber 113 whereas a positive electrical post 160 may be coupled to a positive electrical prong in another insulated chamber 112. The insulated chambers 112 and 113 are separated by the inserted partition wall 210 of the electrical male connector 200 and also by partition walls (i.e., inward protrusions) 190, 192 of the electrical female connector 100. This coupling structure between the electrical male connector and female connector improves sealing as well as delays or inhibit electrolytic corrosion by providing better fittings and a long creepage distance between the positive and negative electrical prong/post as described below.

Figure 6:
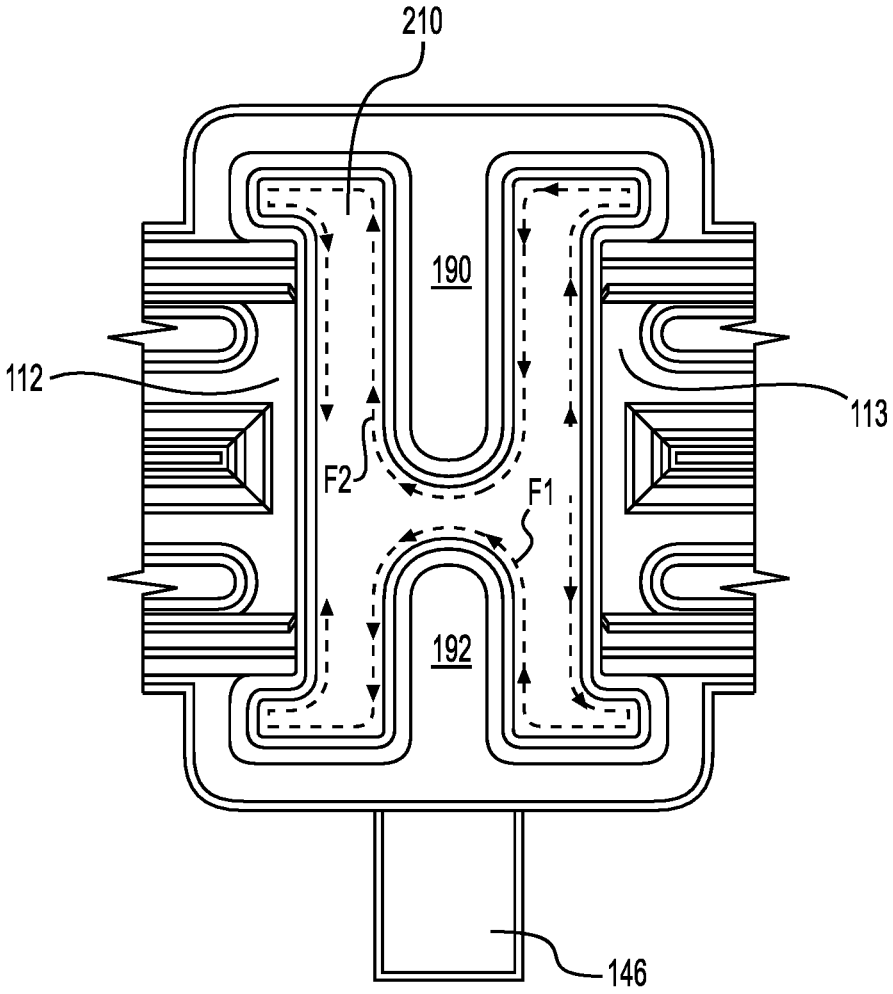
FIG. 6 is an enlarged view of a part "C" of an electrical female connector in a state where an electrical male connector is assembled together.

FIG. 6 is an enlarged view of a part "C" of the electrical female connector 100 as it is assembled with the electrical male connector 200 and illustrates possible flow of fuel that enters into the insulated chambers 112 or 113. Since the "H" shape of the partition wall 210 of the male connector 200 is fitted into the "H" shaped opening of the female connector 100, if the fuel comes into the insulated chamber 112 through a clearance between the partition wall 210, protruding side wall 140 and inward protrusions 190, 192, the fuel only possibly reaches to the next insulated chamber 113 by flowing around the "H" shaped partition wall 210. A possible flow of the fuel is illustrated with an arrow "F1," and "F2" in FIG. 6, and this illustration shows that the specified fitting structure between the electrical female and male connectors creates a long creepage distance between the positive and negative electrical prong/post with a compact size of the connectors. As a result, the electrical connector assembly of the present disclosure not only improves sealing functionality but also significantly limits the possibility of failure of the connector assembly caused by electrolytic corrosion of the positive and negative electrical prongs 220.

Although exemplary forms of the present disclosure have been described for illustrative purposes, those skilled in the art will appreciate that various modifications, additions and substitutions are possible, without departing from the scope and spirit of the present disclosure.

What is claimed is:

1. An electrical female connector having an upper open end for an electrical male connector formed with a plurality of partition walls, the electric female connector comprising:

a lower plate;

a peripheral outer wall extended from the lower plate in a first direction transversely and configured to delimit an inner cavity of the electric female connector with the lower plate, wherein the peripheral outer wall has a plurality of slots that is formed along the first direction and configured to divide the peripheral outer wall into a plurality of wall sections;

a plurality of protruding side walls each protruding from the peripheral outer wall outwardly and respectively configured to continuously connect at least two divided wall sections of the plurality of wall sections to each other such that the peripheral outer wall and the plurality of protruding side walls are configured to form a continuous exterior wall of the electrical female connector; and a plurality of inward protrusions each protruding inwardly from the corresponding protruding side walls and respectively configured to divide the corresponding slot of the plurality of slots into a first sub-slot and a second sub-slot, wherein each of the plurality of protruding side walls is configured to form a chamber configured to receive a corresponding portion of partition walls of the electrical male connector, and wherein the respective slot and the respective chamber form a cross sectional profile compatible with a cross sectional profile of the corresponding portion of the partition wall of the electrical male connector such that when the partition walls of the electrical male connector are inserted into the chambers of the electrical female connector along the respective slot, the inner cavity of the electrical female connector is divided into a plurality of insulated chambers for each electrical post.

2. The electrical female connector of claim 1, wherein the chambers are open to the inner cavity through the corresponding slot.

3. The electrical female connector of claim 1, wherein the respective slot and the respective chamber form a cross sectional profile compatible with a cross sectional profile of the corresponding partition wall of the electrical male connector.

4. The electrical female connector of claim 1, wherein at least two inward protrusions of the plurality of inward protrusions are arranged to face each other such that the at least two inward protrusions and the first and second sub-slots surrounding the at least two inward protrusions form an opening profile compatible with a H-shaped cross section of the corresponding partition wall of the electrical male connector so as to form the plurality of insulated chambers.

5. The electrical female connector of claim 1, wherein at least two inward protrusions of the electrical female connector face to each other and are configured to form a gap (G) configured to receive a corresponding portion of the partition walls of the electrical male connector.

6. The electrical female connector of claim 5, wherein a length of inward protrusion of the facing partition walls is set to be different from each other.

7. An electrical connector assembly, comprising:

a female member including:

a peripheral wall formed in an annular shape to define a first interior space;

a lower plate including a plurality of electrical posts arranged on an upper surface of the lower plate;

a plurality of exterior walls located on an exterior of the peripheral wall, the plurality of exterior walls each formed in a semi-annular shape to define a plurality of second interior spaces located outwardly of the first interior space, wherein the peripheral wall includes a plurality of slots corresponding to the plurality of exterior walls, the plurality of slots communicating the first interior space with the plurality of second interior spaces; and a male member including a plurality of partition walls sized to be received by corresponding second interior spaces and slots whereby the partition walls separate the first interior space into a plurality of chambers for electrical prongs of the male member, wherein a plurality of grooves are formed in the upper surface of the lower plate such that downward end portions of the plurality of partition walls are respectively fitted into the plurality of grooves.

8. The electrical connector assemble of claim 7, wherein electrical posts of the plurality of electrical posts are respectively housed in chambers of the plurality of chambers and configured to respectively couple with the electrical prong of the male member.

9. The electrical connector assemble of claim 7, further comprising: a plurality of inward protrusions each protruding inwardly from corresponding exterior walls of the plurality of exterior walls and configured to respectively divide the plurality of slots into a first sub-slot and a second sub-slot, wherein at least two inward protrusions of the plurality of inward protrusions are arranged to face each other such that the at least two inward protrusions and the first and second sub-slots surrounding the at least two inward protrusions form an opening profile compatible with a H-shaped cross section of a corresponding partition wall of the plurality of partition walls provide insulation for the plurality of chambers.

10. A female member including:

a peripheral wall formed in an annular shape to define a first interior space;

a plurality of exterior walls located on an exterior of the peripheral wall, the plurality of exterior walls each formed in a semi-annular shape to define a plurality of second interior spaces located outwardly of the first interior space, wherein the peripheral wall includes a plurality of slots corresponding to the plurality of exterior walls, the plurality of slots communicating the first interior space with the plurality of second interior spaces; and a corresponding inward protrusion for each exterior wall of the plurality of exterior walls, wherein the inward protrusions respectively protrude inwardly from the exterior walls and configured to respectively divide the second interior spaces and the slots so as to form an opening profile compatible with a H-shaped cross section of a partition wall of an electrical male connector.

* * * * *